US005082138A

United States Patent [19]

McGarvey

[11] Patent Number: 5,082,138

[45] Date of Patent: * Jan. 21, 1992

[54] FIRE RESISTANT TANK CONSTRUCTION

[75] Inventor: David C. McGarvey, San Gabriel, Calif.

[73] Assignee: LRS, Inc., South El Monte, Calif.

[ * ] Notice: The portion of the term of this patent subsequent to Feb. 5, 2008 has been disclaimed.

[21] Appl. No.: 648,969

[22] Filed: Jan. 31, 1991

Related U.S. Application Data

[63] Continuation of Ser. No. 509,142, Apr. 16, 1990, Pat. No. 4,989,750.

[51] Int. Cl.[5] ..... B65D 90/04

[52] U.S. Cl. ..... 220/444; 220/445; 220/453

[58] Field of Search ..... 220/444, 445, 453, 466, 220/467

[56] References Cited

U.S. PATENT DOCUMENTS 2,858,136 10/1958 Rind .
2,860,807 11/1958 Morton .
3,941,272 3/1976 McLaughlin .
3,967,256 6/1976 Galatis .
4,651,893 3/1987 Mooney .
4,685,327 8/1987 Sharp .
4,989,750 2/1991 McGarvey .

*Primary Examiner*—Joseph Man-Fu Moy
*Attorney, Agent, or Firm*—William W. Haefliger

[57] ABSTRACT

Fire resistant tank apparatus is adapted for transportation and for installation above-ground to receive and dispense a liquid hydrocarbon or hydrocarbons, or the like, and includes a metallic tank assembly having a lightweight, triple hulled, wall structure, defining inner, intermediate and outer walls which are spaced apart. Thermal barrier material is located in certain space between such walls, and in such manner that there is no direct heat conducting metallic path between such walls, as for example the intermediate and outer walls. In addition, fire resistant material may be applied to the outer side or sides of the outer walls and hardened to define a relatively lightweight shell enclosing the tank assembly. The structure resists severe heat invasion in the form of radiation, convection and conduction to maintain liquid hydrocarbon in the innermost tank isolated from such invasion. Also, the structure is bullet resistant.

34 Claims, 3 Drawing Sheets

FIRE RESISTANT TANK CONSTRUCTION

This is a continuation of application Ser. No. 509,142 filed Apr. 16, 1990, now U.S. Pat. No. 4,989,750.

BACKGROUND OF THE INVENTION

This invention relates generally to tanks for flammable and combustible liquids, and more particularly concerns methods and means for making such tanks fire resistant in above-ground installation environments.

Tanks holding flammable or combustible liquids, such as new and used hydrocarbon products, if installed above ground, can be dangerous if not "fireproofed", i.e., made "fire resistant". For example, if the tanks leak flammable liquid, a fire danger will exist. Fire can weaken the lightweight tank walls and lead to tank collapse and spillage of tank contents. Also, prior tanks were not, in general, bullet resistant.

In the past, such tanks were enclosed in concrete and transported to installation sites; however, the concrete is subject to cracking, which then can allow leakage to the exterior of flammable liquid leaking from the tank itself. Also, the concrete-enclosed tank is extremely heavy and difficult to transport. There is need for method and means to make such tanks fireproof and leak proof in such a way that a relatively lightweight unit is provided, for ease of transportation and installation, and subsequent safety.

SUMMARY OF THE INVENTION

It is a major object of the invention to provide means meeting the above need. Basically, the apparatus of the invention is embodied in a metallic tank assembly that is fire resistant and defines an effective, efficient thermal barrier, the tank assembly adapted for transportation and for installation aboveground to receive and dispense a liquid hydrocarbon or hydrocarbons, or the like.

It is another object to provide fire resistant tank apparatus that includes:

a) a metallic tank assembly having lightweight wall means defining inner walls means, intermediate wall means and outer wall means, there being primary space between the intermediate wall means and the inner walls means, and secondary space between the intermediate wall means and the outer wall means, b) first means on the assembly defining access porting to a tank interior defined by the assembly, c) a bottom wall defined by the assembly to support the assembly adapted at an installation site, d) and thermal barrier material located in one of the first and second spaces to effectively define a shell about the tank interior.

As will be seen, the thermal barrier material may substantially fill the second space, i.e., the space between the intermediate and outer walls; and the thermal barrier may enclose the tank interior at the top, bottom and sides thereof. The first space may be substantially free of such barrier material.

It is a further object to provide a tank assembly as referred to wherein the inner wall means defines an inner tank forming the tank interior, and the intermediate wall means defines an intermediate tank extending about the inner tank. In this environment, the outer wall means may define an outer tank extending about the intermediate tank.

Yet another object is the provision of such thermal barrier material which includes:

i) pre-formed block or blocks transmitting weight applied by the intermediate tank, ii) filled in barrier material extending about the block or blocks in the second space.

Also, fire resistant material may be applied to the outer tank of the assembly that includes inner and intermediate tanks, the thermal barrier material located between the intermediate and outer tanks. Access porting may be provided at the top of the three tank assembly to enable access to the inner tank; and the bottom wall of the inner tank may be supported by the intermediate tank bottom wall; and the latter may be supported by thermal barrier structure between the bottom wall of the intermediate tank, and the bottom wall of the outer tank.

These and other objects and advantages of the invention, as well as the details of an illustrative embodiment, will be more fully understood from the following specification and drawings, in which:

DRAWING DESCRIPTION

DETAILED DESCRIPTION

Figure 1:
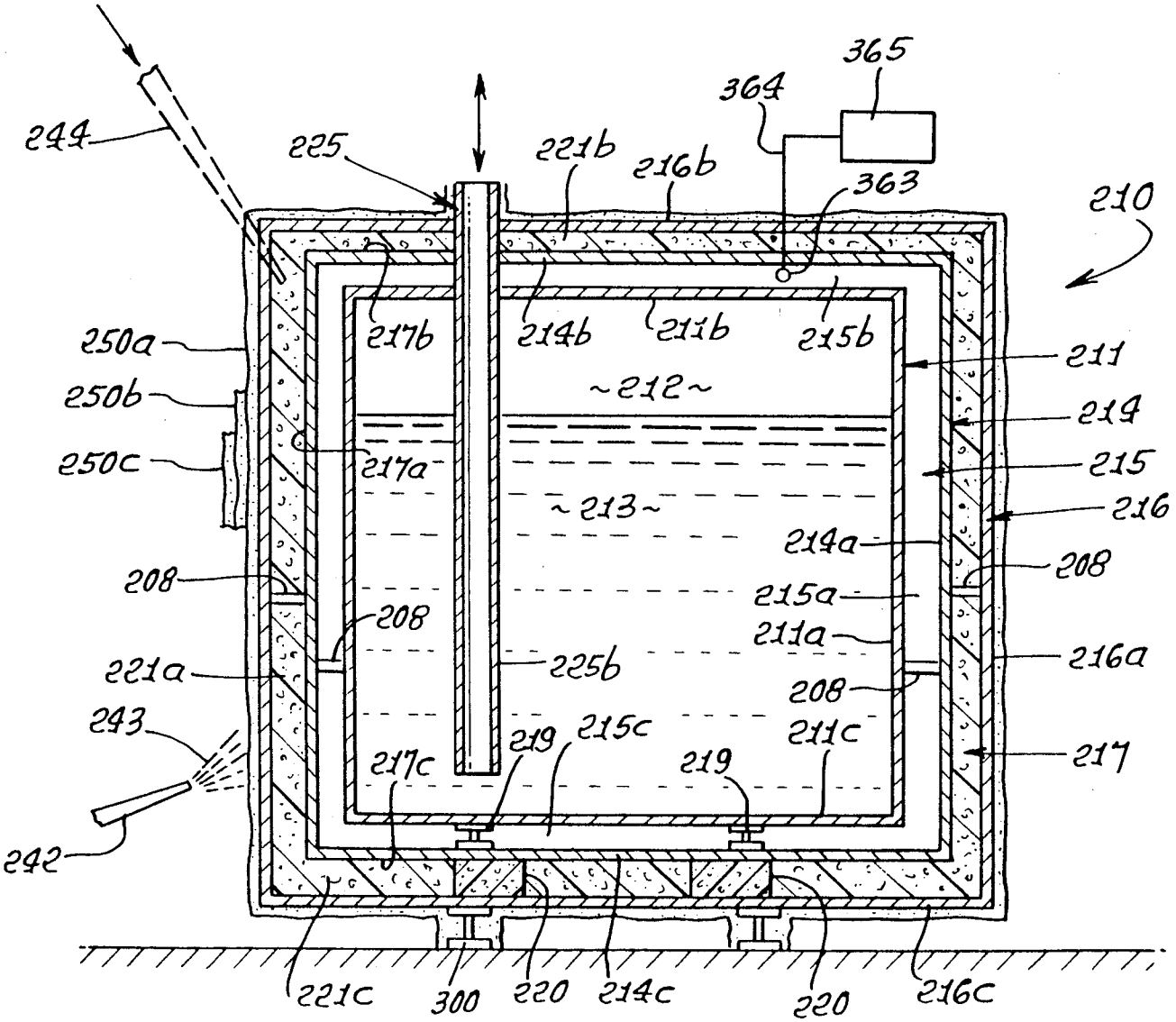
FIG. 1 is a perspective view of a metallic, three-wall tank assembly.

FIG. 1 shows a tank assembly 210 having lightweight wall means defining inner wall means 211, intermediate wall means 214 and outer wall means 216. The inner wall means 211 typically forms an inner tank having a side wall or walls 211*a*, top wall 211*b*, and bottom wall 211*c* whereby an inner tank interior is formed at 212 for containing liquid hydrocarbon indicated at 213, or hydrocarbons, or the like.

The intermediate wall means typically form an intermediate tank having a side wall or walls 214*a*, a top wall 214*b*, and bottom wall 214*c* whereby the intermediate tank encloses the inner tank, and a first space or spacing 215 is formed between the inner and intermediate tanks. See space 215*a*, 215*b* and 215*c*. The outer wall means typically forms an outer tank having side wall or walls 216*a*, top wall 216*b* and bottom wall 216*c* whereby the outer tank encloses the intermediate tank, and a second space or spacing 217 is formed between the outer and intermediate tanks. See space 217*a*, 217*b* and 217*c*.

The three tanks may be cylindrical, or may have multiple flat, parallel side walls. Side walls 211*a*, 214*a* and 216*a* may be parallel, as shown; top walls 211*b*, 214*b* and 216*b* may be parallel, as shown; and hollow walls 211*c*, 214*c* and 216*c* may be parallel, as indicated. Such walls may consist of steel and be less than one inch thick, for lightweight tank construction enhancing portability, for installation above ground at different sites, as desired. Glass fiber walls, or reinforced walls, resin impregnated, are also contemplated. Typically, steel walls are used and are about 10 gauge (⅛ to 174 inch thick). The tank length may typically be about 10–15 feet. The walls are typically interconnected by welds at their junctions, and internal braces may be provided. The overall tank wall thickness is at least about two inches and is bullet small caliber) resistant.

The weight of the inner tank and its liquid contents are transmitted to the intermediate tank, as via steel struts 219 in space 215*c* between bottom walls 211*c* and 214*c*. Such weight, together with the weight of the intermediate tank, is transmitted to the bottom wall 216*c* of the outer tank, as via thermal barrier blocks 220 assembled or positioned in second space 217*c*, as shown, when the tanks are being assembled. Side spacer struts may be provided, locally, as at 208. After positioning of all three tanks as shown, expansible, thermal barrier material is injected, as via nozzle 244, into space 217*a*, 217*b* and 217*c*, and may expand therein as foam, filling such space or spaces and including the intermediate tank. The barrier indicated at 221*a*, 221*b* and 221*c* fills the bottom space 217*c* about the thermal barrier (insulative) blocks 270, all such barrier means then blocking inwardly directed heat transmission to the intermediate steel tank. The barrier material cures in situ, after its injection and expansion. Usable thermal barrier materials include styrofoam, VERMICULITE, and the like. The final thermal barrier consists of the air and other gas in first space 215*a*, 215*b* and 215*c*, and prevents transmission to the contents of the inner tank of fire-generated heat which may for some reason have penetrated barrier foam 221*a*, 221*b* or 221*c*.

FIG. 1 also shows the provision of one or more pipe stubs 225 via which access may be gained to the tank assembly interior 212. As shown, the pipe 225 is connected to top walls 211*b*, 214*b* and 216*b* to extend through them, and above wall 211*b*. The pipe may be ownwardly extended at 225*b* into the inner tank interior for remaining liquid from that interior, as well as filling liquid into that interior. One or more access ports may be provided to the spaces 215*b*, 217*b*, and to the interior space 212. Dipsticks may be inserted into the tank to measure the level of liquid hydrocarbon, i.e., flammable or combustible liquid (such as fuel) in the tank. Monitor means may be installed in the tank via one of the access ports to sense liquid level and transmit corresponding electrical signals to external apparatus that registers the liquid level for ready viewing.

Fire-resistant material is typically sprayed at 243, via a nozzle 242, onto the outermost tank walls 216*a*, 216*b* and 216*c* to form a first layer 250*a* which is allowed to harden or cure in situ. Then, if desired, a second nozzle, or the same nozzle, may be employed to spray the material onto layer 250*a*, forming a second layer 250*b*, also allowed to harden in situ. The combination of thus formed fire resistant sub-shells form a composite shell, leak resistant, fire resistant, and projectile resistant, typically having a thickness between ¼ inch and 1 inch, and which chars when heated to elevated temperatures (1,000° F. to 2,000° F.) as by intense flames.

Figure 2:
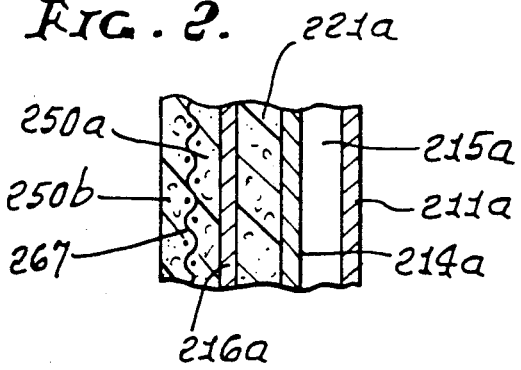
FIG. 2 is a fragmentary section showing multiple sub-shells of fire-resistant material applied to the outer tank of FIG. 1.

FIG. 2 shows a wire mesh 267 applied between layers or shells 250*a* and 250*b* for strengthening purposes. The application of fire-resistant material is preferably such as to coat the exposed pipe stub 225, and the supports 300 under the outer tank bottom wall 216*c*, as shown. An additional sub-shell of fire-resistant material be used, as at 250*c*.

In order that the material 243 being sprayed on may cling to the upright metal walls without sagging out of position, and also to have optimum fireproofing effect, it typically has an epoxide resin base, and chars when exposed to flame. One example is the sprayable two component intumescent epoxy fireproofinq system (CHARTEK) (liquid resin and hardener, mixed with methylene chloride, or 1,1,1,-trichloroethane) supplied by Avco Specialty Materials, Lowell, Mass.

Further, prior to spraying the first layer 250*a* onto the outer tank walls, the latter are preferably sandblasted, and a primer coat applied to resist rusting The primer coat may, for example, consist of polyamide epoxy resin, such as AMERON 71, SUBOX A8051, or VALCHEM 13-R-56, or ethyl silicate inorganic zinc (such as DIMETCOTE 6).

In FIG. 1, the tank assembly is supported by tank supports 300 beneath bottom wall 216*a* and supported by exterior surface 301. The supports have lateral sides which are covered by the fire-resistant material, as at 250*a*'.

Any fluid leaking from inner tank 211 via inner wall or walls 211*a*, 211*b*, 211*c*, or 211*d* passes first to space 215. Such leakage may be detected, as by a sensor 363 sensing volatile gases emitted, or liquids accumulating in space 215, as from a flammable hydrocarbon. The sensor is connected at 364 to an external monitoring device 365, as shown.

Figure 3:
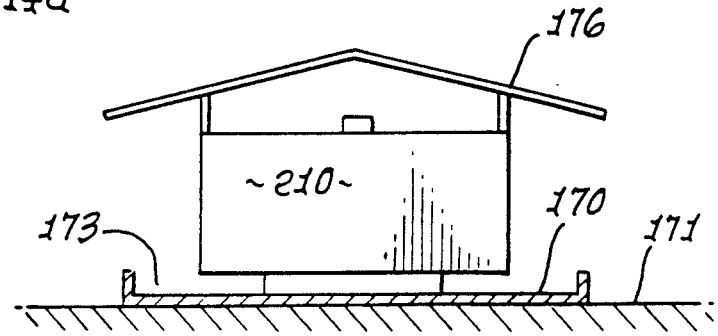
FIG. 3 is a side elevation showing the fireproofed tank supported in a shallow receptacle at an installation site.

FIG. 3 shows a fireproof material coated tank, stub pipes, and supports, installed at a work site, in a basin 170 supported on the ground 171. The basin forms a collection zone 173 beneath the tank to collect any possible leakage of flammable liquid. A hood 176 may be provided over the tank and basin to prevent rainwater accumulation in the basin.

Properties of the "CHARTEK" fireproofing system or material are as follows:

TABLE I

CHARTEK MECHANICAL PROPERTIES

| Property | ASTM Reference | Value | Conditions |
|---|---|---|---|
| Tensile Strength | D638 | 2750 psi<br>$19.0 \times 10^6$ PA | Room Temp. |
| Modulus | | $3.42 \times 10^5$ psi<br>$2.36 \times 10^9$ PA | Room Temp. |
| Compressive Strength | D659 | 6342 psi<br>$43.7 \times 10^6$ PA | Room Temp. |
| Modulus | | $1.89 \times 10^5$ psi<br>$1.3 \times 10^9$ PA | Room Temp. |
| Impact Strength (unsupported, unmeshed) | D256 | 0.42 ft lbs/in<br>0.22 J/cm | Room Temp. notched |
| | | 0.71 ft lbs/in<br>0.38 J/cm | Room Temp. unnotched |
| Flexural Strength | D790 | 4290 psi<br>$29.6 \times 10^6$ PA | Room Temp. |
| Modulus | | $3.32 \times 10^5$ psi<br>$2.3 \times 10^9$ PA | Room Temp. |
| Hardness | Shore D | 83 | D Scale |
| Bond Strength | D1002 | 1578 psi<br>$10.9 \times 10^9$ PA | Primed, room temp. |

TABLE II

PHYSICAL PROPERTIES

| Property | ASTM Reference | Value | Conditions |
|---|---|---|---|
| Density | D792 | 79 lbs/ft$^3$ | After |

TABLE II-continued

| PHYSICAL PROPERTIES | | | |
|---|---|---|---|
| Property | ASTM Reference | Value | Conditions |
| | | 1.27 g/cc | spraying |
| Thermal Conductivity | C177 | 2.10 BTU in/ft$^2$ hr °F. | At 68° F. |
| | | 0.302 W/m °C. | At 20° C. |
| | | 1.96 BTU in/ft$^2$ hr °F. | At 154° F. |
| | | 0.283 W/m °C. | At 68° C. |
| Thermal Expansion With Mesh | D696 | $20.5 \times 10^{-6}$ in/in °F. | From −70° F. |
| | | $36.9 \times 10^{-6}$ cm/cm °C. | (−57° C.) to |
| Thermal Expansion Without Mesh | | $36.4 \times 10^{-6}$ in/in °F. | 150° F. |
| | | $65.5 \times 10^{-6}$ m/cm °C. | (66° C.) |
| Specific Heat | Differential Scanning Calorimetry | 0.33 BTU/lbm °F. | At 86° F. |
| | | 1.38 J/Kg °C. | At 30° C. |
| | | 0.23 BTU/lbm °F. | At 500° F. |
| | | 0.96 J/Kg °C. | At 260° C. |
| Oxygen Index | D2863 | 32 | |
| Flash Point | D92 | | |
| Component I | | Over 200° F. (93° C.) | Open cup |
| Component II | | Over 200° F. (93° C.) | Open cup |
| Viscosity | | | |
| Component I | | 285000 CPS | At 100° F. (37.8° C.) |
| Component II | | 60000 CPS | At 100° F. (37.8° C.) |
| Gas (Nitrogen) Permeability | D1434 | $1.6 \times 10^{-9} \frac{\text{in}^3\ (\text{STP})\ \text{in}}{\text{sec. in}^2\ \text{Atm}}$ | At 68° F. 1.51 Atm |
| | | $1.36 \times 10^{-10} \frac{\text{cm}^3\ (\text{STP})\ \text{cm}}{\text{sec. cm}^2 \cdot \text{cmHg}}$ | At 20° C. 1.53 Bar |
| Water Vapor | E96 | $1.013 \times 10^{-3}$ gr/hr ft$^2$. | At 73° F. (22.8° C.) |
| Transmittance | Procedure B | $4.07 \times 10^{-1}$ g/hr m$^2$ | and 50% RH |
| Pot Life | | 55 minutes | At 70° F. (21° C.) |
| Gel Time | | 8 hours | At 60° F. (16° C.) |
| | | 4 hours | At 80° F. (27° C.) |
| Cure Time to Shore A of 85 | | 18 hours | At 60° F. (16° C.) |
| | | 8 hours | At 80° F. (27° C.) |
| Color | | Grey | |
| Maximum Service Temperature | | 150° F. (66° C.) | Continuous Use |

Figure 5:
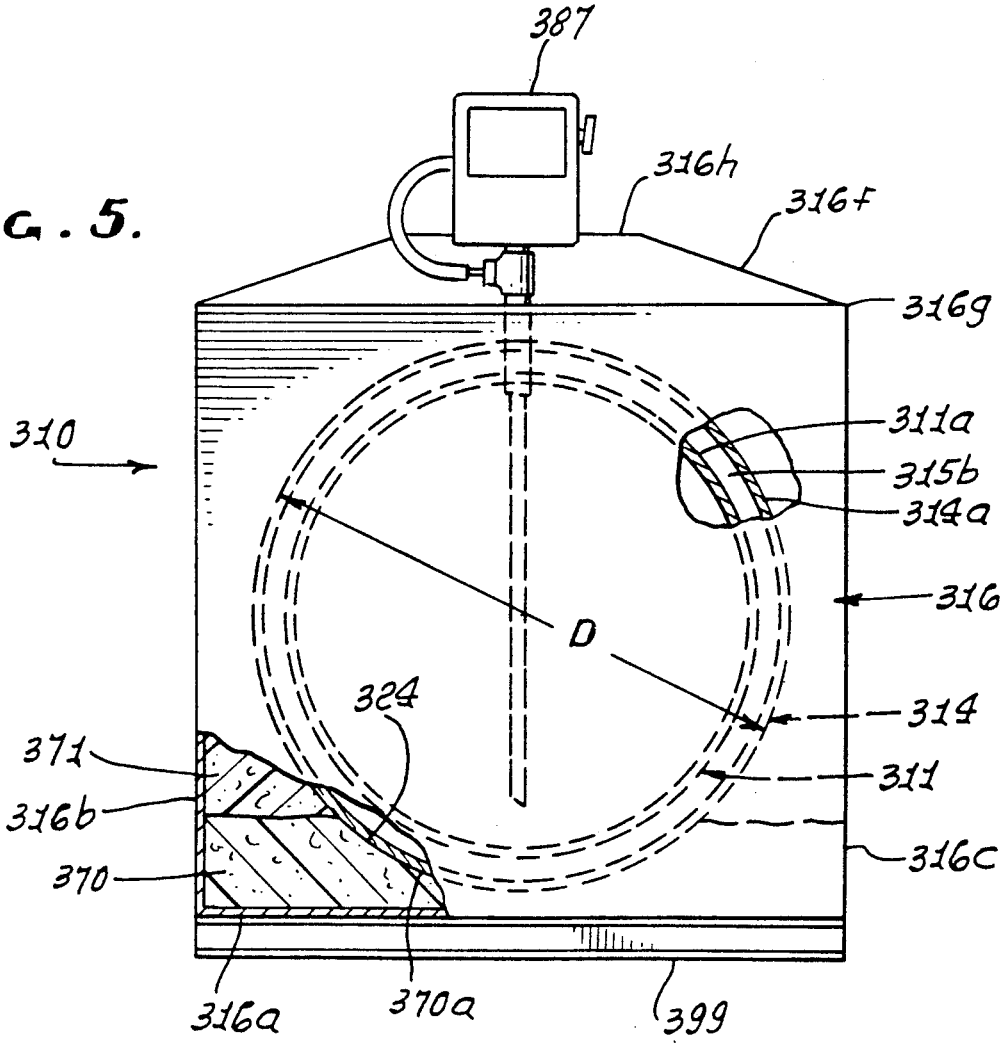
FIG. 5 is an end view of the FIG. 4 apparatus.
Figure 4:
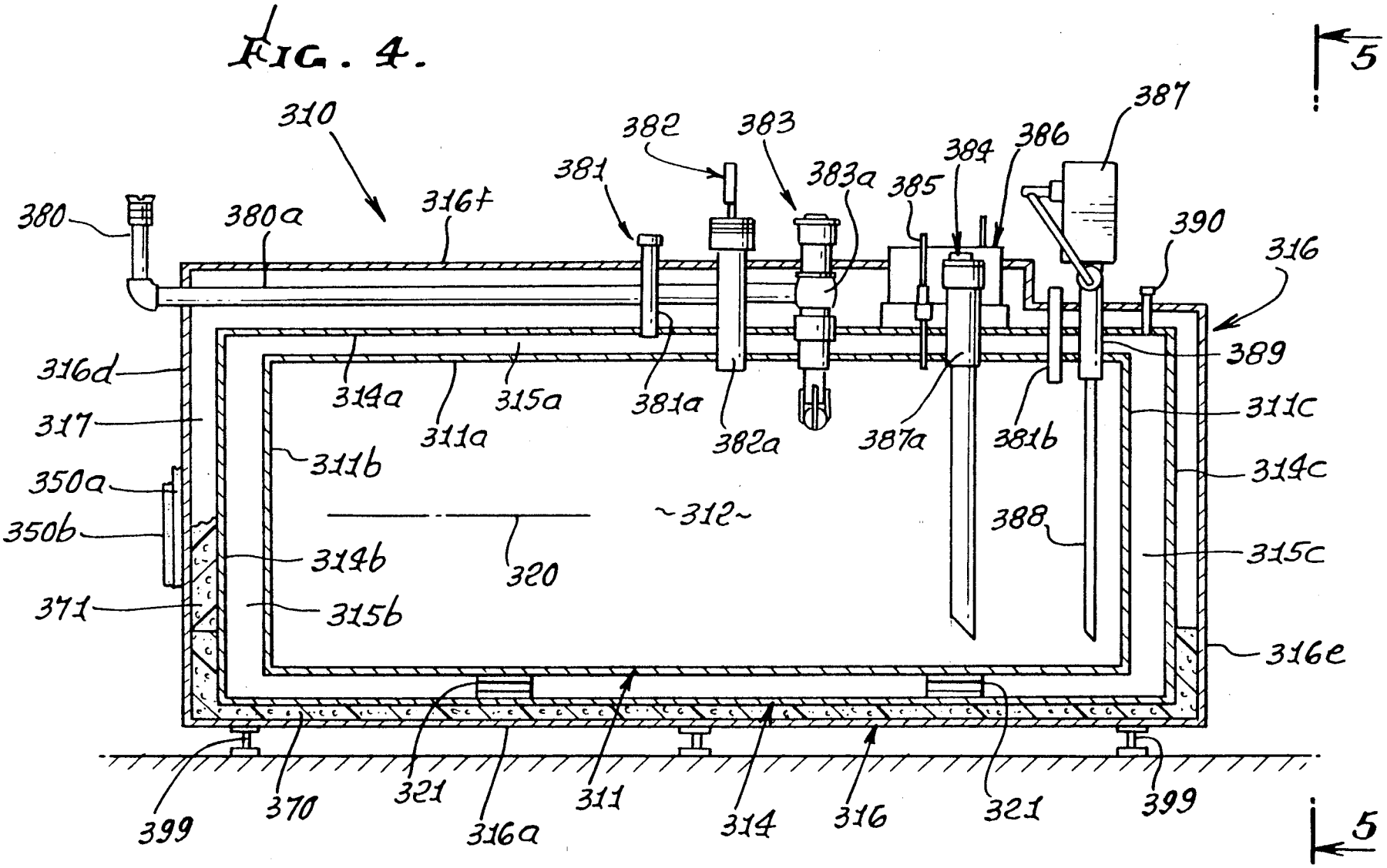
FIG. 4 is a view of modified triple-hulled tank apparatus.

FIGS. 4 and 5 show a multiple wall tank assembly 310 having steel wall means defining an inner tank 311, intermediate tank 314, and outer tank 316. Tanks 311 and 314 are cylindrical and horizontally elongated, having a common axis 320. They have concentric side walls 311*a* and 314*a*, parallel vertical end walls 311*b* and 314*b* at one end, and parallel vertical end walls 311*c* and 314*c* at their opposite ends. The two tanks 311 and 314 are spaced apart at 315*a*, 315*b* and 315*c*. Metal struts 321 in lower extent of space 315*a* support the inner tank and its contents on the side wall 314*a* of the intermediate tank.

The outer tank 316 is rectangular, not cylindrical, but is horizontally elongated in the direction of axis 320. It has a bottom steel wall 316*a*, elongated upright side walls 316*b* and 316*c*, upright ends walls 316*d* and 316*e*, and top wall 316*f* is tapered from level 316*g* to level 316*h*. The three tanks serve the same purposes and functions, as referenced in FIGS. 1 and 2. However, the two cylindrical tanks 311 and 314 are assembled as a unit into outer tank 316, as by lowering onto a saddle 324 formed as by thermal barrier material 370 (corresponding to blocks 270 in FIGS. 1 and 2) previously filled into the outer tank, cured, and forming a concave upper surface 370*a* to match the convex curvature of diameter D, of tank wall 314*a*. See FIG. 5. Subsequently, thermal barrier material is filled into space 317 between tanks 314 and 316 to fill that space at the sides and top of tank 314. Such added thermal barrier material is indicated at 371 in FIGS. 4 and 5. Such barrier material corresponds to that at 221*a*, 221*b* and 221*c* in FIGS. 1 and 2. At the top of tank 314 the thermal barrier material is thickened due to top wall taper at 316*f*. Fire-resistant material is added in layers at 350*a* and 350*b*, corresponding to sub-shells 250*a* and 250*b* in FIG. 1.

Equipment located at the top of the tank assembly is as shown, and includes primary tank work vent 380 and elongated duct 380*a* connecting to 383 secondary tank work vent 381 with duct 381*a* tank gauge unit 382 accessing inner space 312, via duct 382*a* vapor recovery duct 383 accessing space 312, via duct 383*a* fluid product fill duct 384 accessing 312 fluid product spill drain duct 385 fluid spill container 386 associated with 385 product dispenser 387, and associated suction line 388 and vapor return duct 389; see also pipe 387*a* through tank walls, and pipe 377*a'* monitor port 390 via which fluid leaking into open (unfilled) space 315 may be monitored, i.e., detected, as by a sensor 363 a liquid product return line 381*b*.

Tank supports appear at 399.

Space 315 in FIG. 4 and space 215 in FIG. 8 may contain, or be filled, with a non-oxidizable inert gas, such as $N_2$ for enhanced protection in case of leakage of hydrocarbon into the space. Also, the space 317 may contain a barrier layer, such as silica, adjacent side walls of outer tank 316, and which does not foam or bubble when heated to 1,200° F., for example. The assembly, as described, provides protection for the hydrocarbon contents such that up to 2,000° F. flame applied for a considerable period of time (1 to 2 hours) to the fire resistant outer shell 300 on the assembly will not result in heating of the hydrocarbon contents in space 312 (or space 212 in FIG. 1) above about 10% of ambient temperature.

Elongated duct 380*a* is usable as an additional reservoir for heat expanded tank (in space 302) if needed.

The thermal barrier material (in space 217, 220, 371, and 321) may for example consist of the following: Insta-Foam Products, Inc. two components ("A"—activator and "B"—resin) combinable system, further identified as follows:

| IDENTIFICATION (A COMPONENT) | |
|---|---|
| Product: | "A" components for froth refill. |
| Chemical Family: | Aromatic isocyanate with halogenated hydrocarbon |
| Chemical Name: | Product is a mixture of polymeric diphenylmethane diisocyanate (MDI), dichlorodifluoromethane (R-12) and nitrogen. |
| Synonyms: | Urethane "A" component, iso, isocyanate, activator |
| DOT Class: | Compressed gas N.O.S., non-flammable gas UN 1956 |
| INGREDIENTS: | % |
| 4,4' Diphenylmethane Diisocyanate (MDI) CAS #101-68-8 | <50 |
| Higher oligomers of MDI CAS #9016-87-9 | <50 |
| Dichlorodifluoromethane (R-12) CAS #75-71-8 | <20 |
| PHYSICAL DATA: | |
| Appearance: | Liquid and gasses under pressure - frothy liquid upon release from the tank. |
| Color: | Dark brown to amber. |
| Odor: | Mild fluorocarbon odor. |
| Boiling Point: | R-12 is present as a liquified gas and at one atmosphere boils at −21.6° F. or −30° C. MDI is present as a viscous liquid and boils at 406° F. (208° C.) at 5 mm Hg. |
| Vapor Pressure: | Before the addition of nitrogen, the vapor pressure of the mixture is about 2700 mm Hg. |
| Vapor Density (Air = 1): | 8.5 (MDI) |

-continued

| | |
|---|---|
| Solubility in Water: | Reacts slowly with water to liberate carbon dioxide. |
| Specific Gravity (Water = 1): | 1.3 |
| % Volatile by Weight: | Less than 20%. |
| IDENTIFICATION (B COMPONENT) | |
| Product: | "B" Components for froth refill (densities 1.5 pcf through 4.0 pcf) |
| Chemical Family: | Urethane Resin |
| Chemical Name: | Product is a mixture of polyols, urethane catalysts, silicone surfactant, fluorocarbons (R-11 and R-12), flame retardants, and nitrogen. |
| Synonyms: | Urethane "B" Component, Resin |
| DOT Class: | Compressed gas N.O.S., non-flammable gas UN 1956. |
| INGREDIENTS: | % |
| Polyol | <70 |
| Silicone Surfactant | <2 |
| Flame Retardants | <30 |
| Catalyst | <10 |
| Trichlorofluoromethane (R-11) (CAS #73-69-4) | <30 |
| Dichlorodifluoromethane (R-12) (CAS #75-71-8) | <15 |
| PHYSICAL DATA: | |
| Appearnce: | Liquid and gasses under pressure - frothy liquid upon release from the tank. |
| Color: | Brown to light yellow. |
| Odor: | Mild fluorocarbon odor. |
| Boiling Point: | R-12 is present as a liquified gas and at one atmosphere boils at −21.6° F. or −30° C. |
| Vapor Pressure: | Before the addition of nitrogen, the vapor pressure of the mixture is about 2500 mm Hg. |
| Vapor Density (Air = 1): | Greater than 1 (fluorocarbon). |
| Solubility in Water: | Partly soluble; does not react. |
| Specific Gravity (Water = 1): | 1.2 |
| % Volatile by Weight: | Less than 35. |

I claim:

1. In fire resistant tank apparatus adapted for transportation and for installation above-ground to receive and dispense a liquid hydrocarbon or hydrocarbons, or the like, the combination comprising a) a tank assembly having lightweight wall means defining inner wall means, intermediate wall means and outer wall means, there being primary space between the intermediate wall means and the inner wall means, and secondary space between the intermediate wall means and the outer wall means, b) first means on the assembly defining access porting to a tank interior defined by the assembly, c) a bottom wall defined by the assembly to support the assembly at an installation site, d) and thermal barrier material located in one of said first and second spaces to effectively define a shell about said tank interior, e) said tank assembly being horizontally elongated.

2. The combination of claim 1 wherein said thermal barrier material substantially fills said second space.

3. The combination of claim 1 wherein said space containing said thermal barrier material effectively encloses said tank interior at the top, bottom and sides thereof.

4. The combination of claim 2 wherein said second space containing said thermal barrier material effectively encloses said tank interior at the top, bottom and sides thereof.

5. The combination of claim 1 wherein the other of said first and second spaces is substantially free of said thermal barrier material.

6. The combination of claim 1 wherein said inner wall means defines an inner tank forming said tank interior, and said intermediate wall means defines an intermediate tank extending about the inner tank.

7. The combination of claim 6 wherein said outer wall means defines an outer tank extending about the intermediate tank.

8. The combination of claim 1 including fire resistant material applied to said assembly at the outer side thereof.

9. The combination of claim 8 wherein said fire resistant material is applied to the outer wall means, and has thickness between about ¼ inch and 1 inch, said material characterized as charring when exposed to flame.

10. The combination of claim 7 wherein said thermal barrier material substantially fills said second space.

11. The combination of claim 10 wherein said thermal barrier material includes i) pre-formed block or blocks transmitting weight applied by the intermediate tank, ii) synthetic resin foam extending about said block or blocks in said second space.

12. The combination of claim 11 including strut means in said first space and transmitting weight applied by the inner tank and the contents thereof.

13. The combination of claim 8 wherein said fire resistant material is hardened in situ to define a relatively lightweight shell enclosing said apparatus, the shell having thickness between about ¼ inch and 1 inch.

14. The combination of claim 13 wherein said material has an intumescent epoxide resin base.

15. The combination of claim 13 wherein said shell comprises:

a) a first sub-shell extending into contact with said tank outer wall means, and hardened in situ, the first sub-shell having an outer surface, and b) a second sub-shell extending into contact with said first sub-shell outer surface and hardened in situ.

16. The combination of claim 15 wherein the shell also includes at least one additional sub-shell hardened in situ about the outer surface of the next sub-shell closer to the tank walls.

17. The combination of claim 13 including a wire mesh embedding the shell.

18. The combination of claim 13 including at least one upright pipe stub via which access may be gained to the tank assembly interior, the pipe stub connected to the assembly top wall, and said shell extending adjacent to and about the pipe stub.

19. The combination of claim 13 wherein said second means include tank supports projecting downwardly from the assembly, and having sides, the shell extending adjacent to said sides.

20. The combination of claim 13 wherein said material consists of the product CHARTEK.

21. The combination of claim 1 wherein each of the inner, outer and intermediate tank wall means consists of steel and has about 10 gauge thickness, said wall means extending in parallel at each of the following locations:

i) above the tank interior ii) below the tank interior iii) at the side or sides of the tank interior.

22. The combination of claim 1 including said liquid hydrocarbon or hydrocarbons, or the like, are received in said tank interior protectively concealed by said inner wall means, intermediate wall means, and outer wall means.

23. The apparatus of claim 7 wherein the inner and intermediate tanks are cylindrical and elongated horizontally.

24. The apparatus of claim 23 wherein the outer tank has generally vertical side walls or end walls.

25. The apparatus of claim 24 wherein the outer tank has a top wall that is upwardly tapered.

26. The apparatus of claim 24 wherein the thermal barrier material defines a saddle supporting the cylindrical intermediate tanks within the outer tank.

27. The apparatus of claim 1 wherein said thermal barrier material includes a silica-containing layer.

28. The combination of claim 1 wherein said first means defining access porting includes an elongated tube extending between two walls defined by said upper wall means to serve as a heat expanded hydrocarbon vapor reservoir.

29. The combination of claim 7 wherein said first means defining access porting includes at least two of the following connected through the tanks at upper walls thereof:

a primary inner tank work vent duct.

a vapor recovery duct, a fluid product fill duct, an elongated vapor reservoir duct connected between said work duct and said vapor receiving duct, a tank gauge unit duct, a fluid product spill drain duct, liquid product return line.

30. The combination of claim 7 wherein said first means defining access porting includes the following connected through outer and intermediate upper walls of the outer and intermediate tanks to access space between the inner and intermediate tanks:

a secondary intermediate tank work vent duct a monitor port for monitoring vapor in said space.

31. The combination of claim 1 wherein said wall means comprises one of the following: metal and glass fiber.

32. The combination of claim 1 wherein said tank assembly is at least about 2 inches thick to be bullet resistant.

33. In fire resistant tank apparatus adapted for transportation and for installation above-ground to receive and dispense a liquid hydrocarbon or hydrocarbons, or the like, the combination comprising a) a tank assembly having lightweight wall means defining inner walls means, intermediate wall means and outer wall means, there being primary space between the intermediate wall means and the inner wall means, and secondary space between the intermediate wall means and the outer wall means, b) first means on the assembly defining access porting to a tank interior defined by the assembly, c) a bottom wall defined by the assembly to support the assembly at an installation site, d) and thermal barrier material located in one of said first and second spaces to effectively define a shell about said tank interior, e) said tank assembly including at least two tanks, one within the other, f) and said first means defining access porting including at least two of the following connected through the tanks at upper walls thereof;

a primary inner tank work vent duct, a vapor recovery duct, a fluid product fill duct, an elongated vapor reservoir duct connected between said work duct and said vapor recovery duct, a tank gauge unit duct, a fluid product spill drain duct, a product dispenser duct, liquid product return line.

34. In fire resistant tank apparatus adapted for transportation and for installation above-ground to receive and dispense a liquid hydrocarbon or hydrocarbons, or the like, the combination comprising a) a tank assembly having lightweight wall means defining inner walls means, and outer wall means there being primary space between the inner wall means and the outer wall means, b) first means on the assembly defining access porting to a tank interior defined by the assembly, c) a bottom wall defined by the assembly to support the assembly at an installation site, d) and thermal barrier material located in said space to effectively define a shell about said tank interior, e) said tank assembly including at least two tanks, one within the other, both said two tanks being horizontally elongated, f) and said first means defining access porting including at least two of the following connected through the tanks at upper walls thereof;

a primary inner tank work vent duct, a vapor recovery duct, a fluid product fill duct, an elongated vapor reservoir duct connected between said work duct and said vapor recovery duct, a tank gauge unit duct, a fluid product spill drain duct, a product dispenser duct, liquid product return line.

* * * * *

Disclaimer 5,082,138—David C. McGarvey, San Gabriel, Calif. FIRE RESISTANT TANK CONSTRUCTION. Patent dated January 21, 1992. Disclaimer filed by assignee, LRS, Inc.

The term of this patent shall not extend beyond the expiration date of Pat. Nos. 5,004,632, 5,012,949, and 5,038,456.

*(Official Gazette, June 10, 2003)*